US006181118B1

(12) United States Patent
Meehan et al.

(10) Patent No.: US 6,181,118 B1
(45) Date of Patent: Jan. 30, 2001

(54) CONTROL CIRCUIT FOR CONTROLLING A SEMI-CONDUCTOR SWITCH FOR SELECTIVELY OUTPUTTING AN OUTPUT VOLTAGE AT TWO VOLTAGE LEVELS

(75) Inventors: Patrick Meehan, Pallaskenry; Brian Anthony Moane, Raheen; George Francis Clernon, Dooradoyle, all of (IE)

(73) Assignee: Analog Devices, Inc., Norwood, MA (US)

( * ) Notice: Under 35 U.S.C. 154(b), the term of this patent shall be extended for 0 days.

(21) Appl. No.: 09/339,151

(22) Filed: Jun. 24, 1999

(51) Int. Cl.[7] ..... G05F 1/40
(52) U.S. Cl. ..... 323/274; 323/279; 323/280
(58) Field of Search ..... 363/282, 274, 363/275, 276, 279, 281, 280; 364/707, 140.04; 713/300, 310, 320, 323, 340

(56) References Cited

U.S. PATENT DOCUMENTS 4,749,877 * 6/1988 Asazawa et al. ..... 307/296
5,490,117 * 2/1996 Oda et al. ..... 365/226
5,613,130 * 3/1997 Teng et al. ..... 395/750
5,973,416 * 10/1999 Guenther ..... 323/282

* cited by examiner

*Primary Examiner*—Peter S. Wong
*Assistant Examiner*—Gary L. Laxton
(74) *Attorney, Agent, or Firm*—Wolf, Greenfield & Sacks, P.C.

(57) ABSTRACT

A control circuit (1) for controlling a FET (2) for outputting a 3.3 volt or a regulated 1.5 volt output to an AGP bus on a PC motherboard in response to a TYPEDET signal being applied to a control terminal (3) of the control circuit (1) through an input (6) of a voltage divider circuit (8). The TYPEDET signal is received from a video card receiving slot and indicates the type of video card in the slot of the motherboard. An amplifier (20) outputs a control signal to the gate of the FET (2) for either disabling the FET (2), or enabling the FET (2) to output the 1.5 volt or the 3.3 volt outputs. A decoding circuit (30) decodes the state of the control terminal (3) and controls the amplifier (20) to disable the FET (2) during power up. When the TYPEDET signal of zero volts, the FET (2) is operated to output the 1.5 regulated voltage output. When the TYPEDET signal is floating, the FET (2) outputs the 3.3 source voltage. When the voltage on the control terminal (3) is not connected to the voltage divider circuit (8), the FET (2) is operated to output the 1.5 regulated voltage.

19 Claims, 3 Drawing Sheets

| Input Pin 6 Voltage | Control Terminal 3 | | Inverters Outputs | | | Output Pin 5 Voltage |
|---|---|---|---|---|---|---|
| | State | Voltage | A | B | C | |
| 0V or Floating | First | Ground | 1 | 1 | 1 | 0V |
| 0V | Second | 2V to 3.9V | 0 | 1 | 1 | 1.5V |
| Floating | Third | 4.3V to 8V (5V) | 0 | 0 | 1 | 3.3V |
| Not Applicable | Fourth | 12V approx | 0 | 0 | 0 | 1.5V |

Fig. 3

CONTROL CIRCUIT FOR CONTROLLING A SEMI-CONDUCTOR SWITCH FOR SELECTIVELY OUTPUTTING AN OUTPUT VOLTAGE AT TWO VOLTAGE LEVELS

FIELD OF THE INVENTION

The present invention relates to a control circuit for controlling a semi-conductor switch for selectively outputting an output voltage at two respective levels from a voltage source in response to an input signal. In particular, the invention relates to a control circuit for controlling a field effect transistor (FET) for selectively outputting an output voltage at two respective levels to an AGP bus on a PC motherboard in response to a TYPEDET signal from a sensor in a video card receiving slot on the motherboard indicating the type of video card inserted in the card receiving slot, although the invention is not so limited.

BACKGROUND TO THE INVENTION

In general, PC motherboards are provided with a video card receiving slot for receiving a video card. Originally, one type of video card was provided, and this required that a 3.3 volt supply should be applied to the terminating resistors of the AGP bus on the PC motherboard. However, more recently a second type of video card has been introduced which will operate in the same video card receiving slot but requires that a regulated 1.5 volt supply should be provided to the terminating resistors of the AGP bus on the PC motherboard, In general, a sensor is provided in the video card receiving slot for detecting the type of video card inserted in the slot. This sensor outputs a signal which, in general, is referred to as a TYPEDET signal which, when it is at zero volts indicates that a video card requiring the regulated 1.5 volt supply has been inserted in the video card slot, and when the TYPEDET signal is floating, a 3.3 volt supply is required. A control circuit is therefore required for decoding the TYPEDET signal and for selecting an output voltage at the two respective levels of 1.5 volts regulated and 3.3 volts from a voltage source for applying to the terminating resistors of the AGP bus in response to the TYPEDET signal. It is preferable that such a control circuit should be adapted to isolate the AGP bus from the voltage source during power up to avoid power up sequencing problems. A further requirement of such a control circuit may be that in the event of a control terminal of the control circuit being isolated from the TYPEDET signal and remaining unconnected to any signal, in other words, being in a floating state, the voltage applied to the terminating resistors of the AGP bus should also be 1.5 volts regulated. It is important that any such control circuit for controlling the voltage to the terminating resistors of the AGP bus in response to the various inputs should have the minimum number of terminals so that the circuit can be implemented in the form of an IC chip with the minimum number of pins. Ideally, the number of pins should not exceed five.

OBJECTS OF THE INVENTION

It is an object of the present invention to provide a control circuit for selectively controlling an output voltage at two voltage levels from a voltage source for applying to the terminating resistors of an AGP bus in response to a TYPEDET signal. It is also an object of the invention to provide a control circuit for controlling a semi-conductor switch for selectively outputting an output voltage at two voltage levels from a voltage source in response to an input signal.

SUMMARY OF THE INVENTION

According to the invention there is provided a control circuit for controlling a semi-conductor switch for selectively outputting an output voltage at two respective selectable levels from a voltage source in response to an input signal, the circuit comprising an output terminal for applying a control signal to a gating input of the semi-conductor switch for selecting the output voltage therefrom, a ground terminal for connecting the circuit to ground, a power supply terminal for connecting the circuit to a power supply voltage, a control terminal for receiving the input signal, the control terminal being adapted to be in any one of at least three states, and a feedback terminal for receiving feedback from the output voltage from the semi-conductor switch, the control circuit further comprising:

a decoding means for decoding the state of the control terminal, and a regulating means for outputting the control signal to the output terminal, the regulating means being responsive to the decoding means for outputting the control signal at an appropriate level for selecting the voltage output level from the semi-conductor switch in response to the state of the control terminal, and being responsive to the feedback signal on the feedback terminal for regulating the output voltage from the semi-conductor switch at one of the two selectable levels.

In one embodiment of the invention in a first of the at least three states of the control terminal, the control terminal is pulled to ground, and the regulating means is responsive to the control terminal being in the first state for outputting the control signal at a level for holding the semiconductor switch switched off.

Preferably, the control terminal is adapted for receiving the input signal through a voltage dividing means, the voltage dividing means being connected between a secondary voltage supply and an input terminal for receiving the input signal and for applying the input signal to the control terminal so that the signal applied to the control terminal is a function of the secondary voltage and the input signal. Preferably, the secondary voltage lies between the power supply voltage and ground.

In another embodiment of the invention a second state of the at least three states of the control terminal corresponds to a voltage being applied to the input terminal, and the voltage on the input terminal being different to the secondary voltage, and the secondary voltage lying between the power supply voltage and the voltage on the input terminal, and a third state of the at least three states of the control terminal corresponds to the voltage on the input terminal floating.

In a further embodiment of the invention the control terminal may be in a fourth state floating, the regulating means being responsive to the control terminal being in the fourth state for outputting the control signal at a level for operating the semi-conductor switch for outputting the output voltage at one of the two selectable levels.

Preferably, the control terminal is connected to the supply voltage through a high impedance means for pulling the voltage on the control terminal to the supply voltage when the control terminal is in the fourth state, Preferably, the regulating means is responsive to the control terminal being in the second and fourth states for outputting the control signal at the level for selecting the semi-conductor switch to output the regulated voltage.

Advantageously, the regulating means is responsive to the control terminal being in the third state for outputting the control signal at a level for selecting the semi-conductor switch to act as a low impedance switch for outputting a voltage substantially similar to the source voltage.

In one embodiment of the invention the decoding means comprises a decoder for outputting a decoded signal to the regulating means in response to the state of the control terminal, a first inverting means and a second inverting means connected in parallel between the control terminal and the decoder for determining the state of the control terminal, the inversion threshold voltage of the first and second inverting means being less than the third state voltage of the control terminal, the inversion threshold voltage of the first inverting means being less than the second state voltage of the control terminal, and the inversion threshold voltage of the second inverting means being greater than the second state voltage of the control terminal.

In a further embodiment of the invention the decoding means comprises a third inverting means connected in parallel with the first and second inverting means between the control terminal and the decoder for determining the state of the control terminal, the inverter threshold voltage of the third inverting means being less than the fourth voltage state of the control terminal and greater than the third voltage state of the control terminal, Preferably, the first, second and third inverting means are provided by first, second and third inverters, respectively.

Ideally, the decoder outputs an enable signal and a voltage select signal to the regulating means, the regulating means being responsive to the enable signal and the voltage select signal for outputting the control signal at the appropriate level to the output terminal.

In another embodiment of the invention the regulating means comprises an amplifier for outputting the control signal to the output terminal, the amplifier having a reference voltage input for receiving a reference voltage, and a feedback input for receiving the feedback voltage from the feedback terminal for comparison with the reference voltage, the control signal outputted by the amplifier being responsive to the feedback voltage for regulating the voltage output of the semi-conductor switch at the regulated voltage level.

Preferably, the amplifier is powered by the power supply voltage, and the enable signal and the voltage select signal from the decoding means are fed to control inputs of the amplifier.

Advantageously, the amplifier outputs the control signal at a value approaching the supply voltage for forcing the semi-conductor switch to act as a low impedance switch for outputting the voltage at a level substantially similar to the source voltage to the semi-conductor switch.

Advantageously, a reference voltage generating means is provided for applying the reference voltage to the reference voltage input of the amplifier.

In one embodiment of the invention the control circuit is for controlling a semi-conductor switch provided by a field effect transistor, for example a bi-polar junction transistor.

In another embodiment of the invention the control circuit comprises the semi-conductor switch.

In a further embodiment of the invention the control circuit comprises the voltage dividing means.

Ideally, the control circuit is adapted for receiving an input signal provided by a TYPEDET signal from a sensor in a video card receiving slot, and for controlling the semi-conductor switch for selectively outputting the output voltage to terminating resistors of an AGP bus of a PC motherboard at a selected one of the two respective voltage levels in response to the state of the control terminal.

ADVANTAGES OF THE INVENTION

The advantages of the invention are many. The control circuit according to the invention provides a particularly simple low cost circuit for selectively applying an output voltage at two selectable voltage levels to the terminating resistors of an AGP bus on a PC motherboard in response to a two state TYPEDET signal, and indeed, for applying an output voltage at two selectable voltage levels for any other purpose in response to an input signal which can be in any one of four states. The use of the control circuit for selectively controlling a FET for outputting an output voltage at two respective levels to the AGP bus provides a circuit which can readily easily be implemented in an integrated circuit chip with only five pins. Since the control circuit is adapted to accommodate the control terminal in four respective states, the control circuit can disable the FET during power up to avoid power up sequencing problems. In the event that the control terminal remains unconnected to the TYPEDET signal or any other circuitry of the PC, the FET is controlled to output at one of the selectable levels. Depending on state of the TYPEDET signal the FET is controlled for outputting the output voltage at the corresponding desired level. A particularly important advantage of the invention is that by virtue of the fact that two of the states of the control terminal are determined by the use of the voltage dividing means, the voltage dividing means may be implemented by two small resistors, which take up little board space, and thus, provide a simple method for determining two of the states of the control terminal which is economic both in space and cost.

Additionally, the control circuit may comprise an additional amplifier for outputting a second control signal on a second output terminal in response to an input on a second control terminal and in response to a second feedback terminal. In such a case the control circuit could be implemented as an eight pin control circuit.

These objects and advantages of the invention will be more clearly understood from the following description of a preferred embodiment thereof which is given by way of example only with reference to the accompanying drawings.

BRIEF DESCRIPTION OF THE DRAWINGS

FIG. 3 is a logic table illustrating the operation of the control circuit of FIG. 1.

Figure 1:
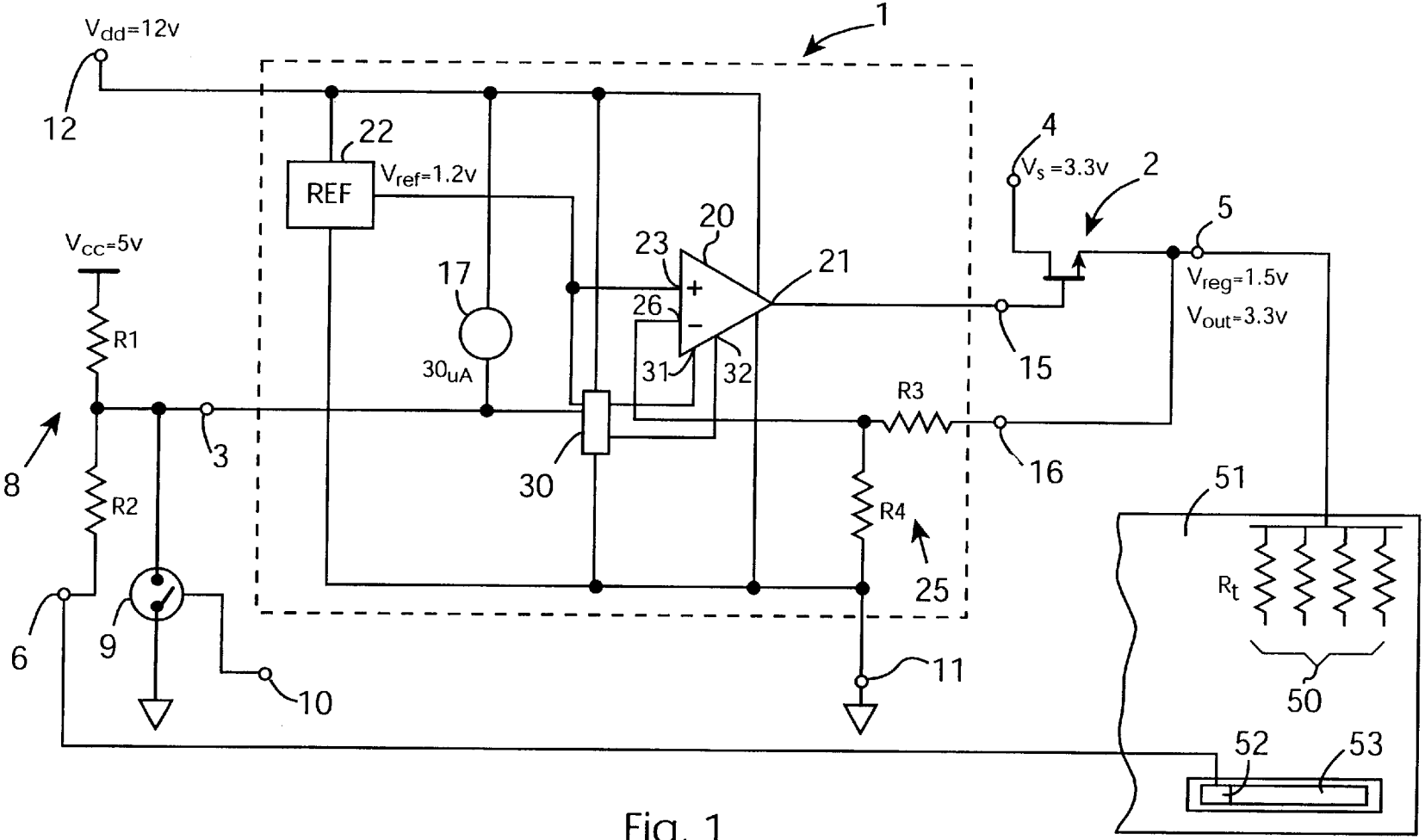
FIG. 1 is a circuit diagram of a control circuit according to the invention for controlling a FET for selectively outputting an output voltage at two respective levels to terminating resistors of an AGP bus on a PC motherboard.
Figure 2:
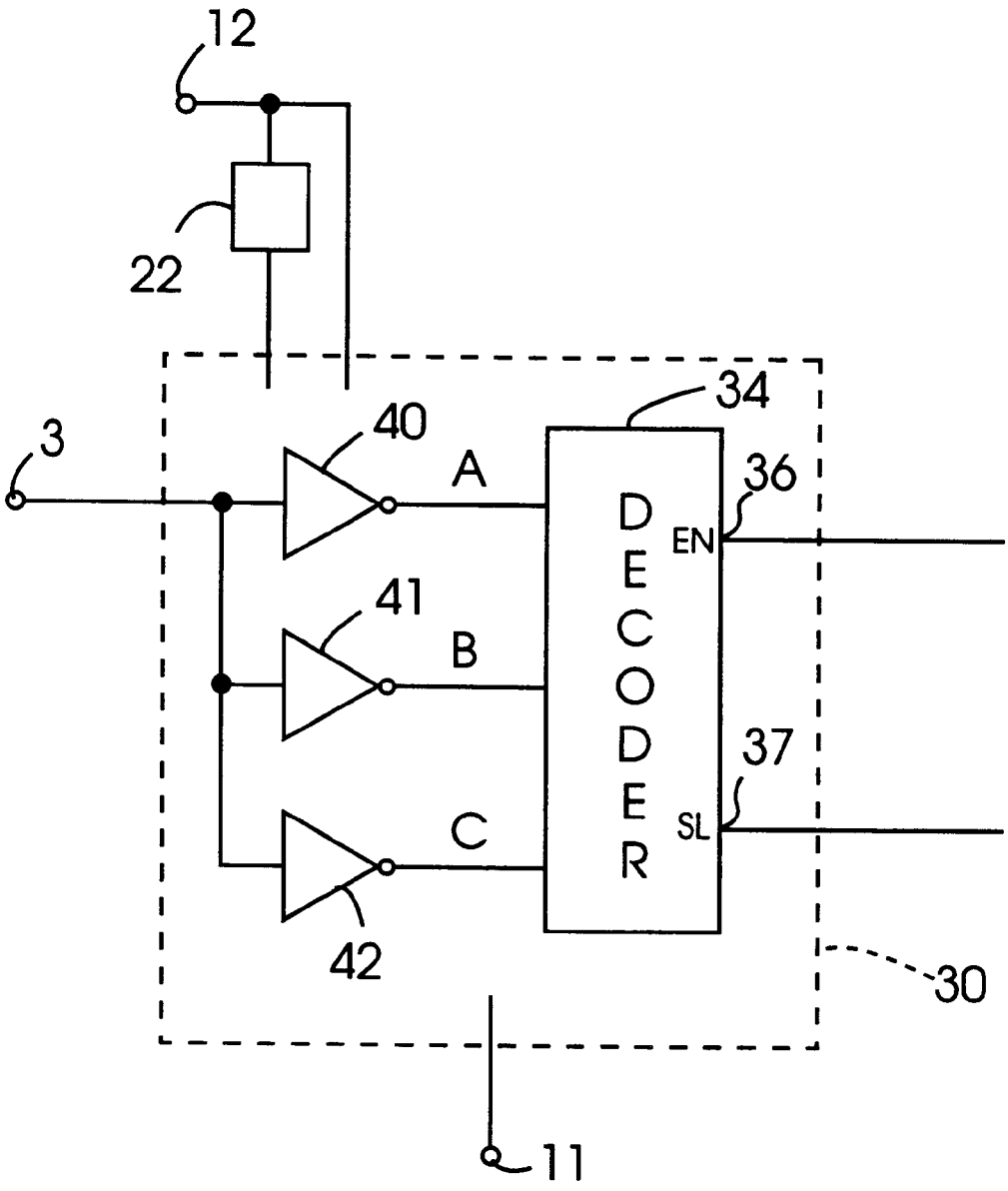
FIG. 2 is a circuit diagram of a detail of the control circuit of FIG. 1.

Referring to the drawings and initially to FIGS. 1 and 2 there is illustrated a control circuit according to the invention which is indicated generally by the reference numeral 1. The control circuit 1 is suitable for controlling a semi-conductor switch. namely, an NMOS FET 2 for selectively outputting an output voltage at two levels for applying to terminating resistors $R_t$ of an AGP bus 50 on a PC motherboard 51. The output voltage level from the FET 2 is selected by the control circuit 1 in response to an input signal received on a control terminal 3 of the control circuit 1, and also in response to the state of the control terminal 3, The input signal is derived from a TYPEDET signal from a sensor 52 in a video card receiving slot 53 on the motherboard 51 as will be described below. In this embodiment of the invention one of the output voltage levels is $V_{out}$ a 3.3 volt output approximately which is outputted on an output 5 of the FET 2 and is derived from a voltage source $V_s$ of 3.3 volts, approximately, supplied to the drain 4 of the FET 2. The other output voltage level is $V_{reg}$ a 1.5 volt regulated output voltage which is also delivered on the output 5 of the FET 2, and is likewise derived from the voltage source $V_s$. The FET 2 is also controlled by the control circuit 1 for outputting a zero volt output on the output 5.

The TYPEDET signal is applied on an input terminal 6 to the control terminal 3 of the control circuit 1 through a voltage dividing means, namely, a volt age divider circuit 8. The voltage divider circuit 8 comprises resistors R1 and R2 connected in series between the input terminal 6 and a secondary voltage supply $V_{cc}$ of 5 volts of the PC power supply. The TYPEDET signal appearing on the input pin 6 will be zero volts when the 1.5 volt regulated output is required on the FET output 5, and will be floating when the 3.3 volt output is required on the FET output 5. The value of the resistors R1 and R2 are chosen so that when the TYPEDET signal is at zero volts the voltage appearing on the control terminal 3 is pulled up by the secondary voltage $V_{cc}$ to lie between 2 volts and 3.9 volts, When the TYPEDET signal is floating the voltage on the control terminal 3 is pulled up to 5 volts by the secondary voltage $V_{cc}$ on the pin 10.

A switch means, namely, an electronic switch 9 is connected to the control terminal 3 for pulling the voltage on the control terminal 3 to ground during power up to avoid power up sequencing problems. A gating terminal 10 of the switch 9 may be connected to any suitable control signal for operating the switch 9. The control signal may be derived from the control circuit 1 or from the motherboard of the PC.

The control circuit 1 accommodates four states of the control terminal 3. The first state of the control terminal 3 is when the voltage on the control terminal 3 is pulled to ground by the switch 9. The second state of the control terminal 3 is when the TYPEDET signal is at zero volts and the voltage of the control terminal 3 lies between 2 volts and 3.9 volts. The third state of the control terminal 3 is when the TYPEDET signal is floating, and the voltage on the control terminal 3 is thus equal to $V_{cc}$, approximately 5 volts. The fourth state is when the control terminal 3 is floating, in other words, when the control terminal 3 is not connected to the voltage divider circuit 8. In this state the voltage on the control terminal 3 is pulled up to the voltage of a power supply $V_{dd}$ to the control circuit 1 of approximately 12 volts, as will be described below. A logic table in FIG. 3 illustrates these four states of the control terminal 3. In the first state when the voltage on the control terminal 3 is pulled to ground, the output voltage on the output 5 from the FET 2 is zero volts. In the second state when the voltage on the control terminal 3 lies between 2 volts and 3.9 volts, the output voltage on the output 5 of the FET 2 is $V_{reg}$ 1.5 volts. In the third state when the voltage on the control terminal 3 is at approximately 5 volts, the output voltage on the output 5 from the FET 2 is $V_{out}$ 3.3 volts. In the fourth state when the voltage on the control terminal 3 is pulled up to the 12 volt power supply voltage $V_{dd}$ the output voltage on the output 5 from the FET 2 is $V_{reg}$ 1.5 volts.

As well as the control terminal 3, the control circuit 1 comprises four other terminals, namely, a ground terminal 11 for connecting the circuit 1 to ground, a power supply terminal 12 through which the control circuit 1 is connected to the 12 volt power supply $V_{dd}$ of the PC, an output terminal 15 through which a control signal is applied to the gate of the FET 2 for control ling the output voltage level from the FET 2 on the output 5, and a feedback terminal 16 through which the output voltage on the output 5 of the FET 2 is fed back to the control circuit 1. When the control circuit 1 is implemented as an integrated circuit chip, the control terminal 3, the ground terminal 11, the power supply terminal 12, the output terminal 15 and the feedback terminal 16 are implemented as five respective pins of the chip.

A high impedance means provided by an internal 30 micro-amp high impedance current source 17 is connected between the control terminal 3 and the power supply terminal 12 for pulling up the voltage on the control terminal 3 to approximately 12 volts of the power supply voltage $V_{dd}$ when the control terminal 3 is floating in the fourth state.

A regulating means, namely an amplifier 20 of the control circuit 1 is powered by the 12 volt supply $V_{dd}$ on the power supply terminal 12. An output 21 of the amplifier 20 applies the control signal on the output terminal 15 for controlling the FET 2 through its gate. A voltage reference 22 powered by the 12 volt supply $V_{dd}$ on the power supply terminal 12 provides a 1.2 volt reference voltage $V_{ref}$ to a reference voltage input 23 of the amplifier 20. The feedback terminal 16 is connected through a feedback voltage divider 25 comprising resistors R3 and R4 to a feedback input 26 of the amplifier 20 which compares the voltage on the feedback input 26 with the reference voltage on the voltage reference input 23. The resistors R3 and R4 are selected so that when the voltage on the output 5 of the FET 2 is to be maintained at $V_{reg}$, the voltage being fed back to the feedback input 26 is approximately 1.2 volts. Thus, when the amplifier 20 is operated to control the FET 2 for outputting the 1.5 volt regulated output $V_{reg}$, the control signal from the output 21 of the amplifier 20 maintains the output voltage from the FET 2 regulated at 1.5 volts. In order to provide the output voltage on the output 5 from the FET 2 at 3.3 volts the amplifier 20 applies the 12 volt power supply voltage $V_{dd}$ onto the gate of the FET 2 for forcing the FET 2 to act as a low impedance switch, and the 3.3 volt source voltage $V_s$ through thus outputting onto the output 5.

A decoding means comprising a decoding circuit 30 in the control circuit 1 is connected to two control inputs 31 and 32 of the amplifier 20, and determines the control signal on the output 21 of the amplifier 20 in response to the state of the control terminal 3. The decoding circuit 30 comprises a decoder 34, see FIG. 2, having two outputs, namely, a two level enable/disable output 36 for outputting an enable/disable signal to the control input 31 of the amplifier 20 for enabling or disabling the FET 2, and a select output 37 for outputting a two level voltage select signal to the control input 32 of the amplifier 20 for selecting the control signal to be applied to the output terminal 15 of the amplifier 20 for selecting the FET 2 to output the selected output voltage $V_{out}$ or $V_{reg}$ on the output 5.

Three inverting means, namely, first, second and third inverters 40, 41 and 42, respectively, are connected between the control terminal 3 and the decoder 34 for determining and encoding the state of the control terminal 3 for subsequent decoding by the decoder 34. All three inverters 40, 41 and 42 are chosen to have an inversion threshold voltage of less than 12 volts so that when the control terminal 3 is in the fourth state at a voltage of approximately $V_{dd}$ all three inverters 40, 41 and 42 will have inverted and their respective outputs A, B and C will be "0". The first and second inverters 40 and 41 are chosen to have an inversion threshold voltage less than 4.3 volts so that both will have inverted when the control terminal 3 is in the third state at a voltage between 4.5 volts and 8 volts. The first inverter 40 is chosen to have an inversion threshold voltage of less than 2 volts so that it will have inverted when the control terminal 3 is in the second state at a voltage between 2 volts and 3.9 volts. However, the inversion threshold voltage of the first inverter 40 is also chosen so that it will not invert while the control terminal is in the first state at ground. The inversion threshold of the second inverter 41 is greater than 3.9 volts so that it will not invert until the control terminal 3 is in the third state at approximately 5 volts. The inversion threshold voltage of the third inverter 42 is greater than the 8 volts so that it will not invert until the control terminal is in the fourth state at 12 volts, approximately. FIG. 3 shows the logic outputs A, B and C of the inverters 40, 41 and 42 respectively for the four states of the control terminal 3.

Referring now to the logic table of FIG. 3, when the control terminal 3 is in the first state with its voltage at ground, namely, less than 0.8 volts, the outputs A, B and C of the first, second and third inverters 40, 41 and 42 remain high, and the output from the decoder 34 on the enable output 36 is low to operate the amplifier 20 for outputting a zero volt control signal to the gate of the FET 2 for disabling the FET 2. Thus, the output voltage on the output 5 of the FET 2 is zero volts. When the control terminal 3 is in the second state with its voltage lying between 2 volts and 3.9 volts the output A of the first Inverter 40 goes low, and the outputs B and C of the second and third inverters 41 and 42 remain high. This, thus causes the enable output 36 of the decoder 34 to go high for enabling the amplifier 20. The voltage select output 37 of the decoder 34 goes low for controlling the amplifier 20 to control the FET 2 to output the regulated output voltage $V_{reg}$ of 1.5 volts on the output 5. When the control terminal 3 is in the third state with its voltage at 5 volts, approximately, the outputs A and B of the first and second inverters 40 and 41 go low, while the output C of the third inverter 42 remains high. This causes the enable output 36 of the decoder 34 to go high for enabling the amplifier 20 and the select output 37 to go high for controlling the amplifier 20 for applying the 12 volt supply voltage $V_{dd}$ to the gate of the FET 2 for forcing the FET 2 into its low impedance state to output the 3.3 volt source voltage $V_s$ onto the output 5. When the control terminal 3 is in the fourth state with its voltage at 12 volts approximately, $V_{dd}$ the outputs A, B and C of the first, second and third inverters 40, 41 and 42 will all have gone low. This causes the enable output 36 of the decoder 34 to go high for enabling the amplifier 20, and the voltage select output 37 of the decoder 34 to go low for operating the amplifier 20 to output a control signal on the output 21 in response to the voltage and the feedback input 16 for regulating the output voltage from the FET 2 on the output 5 at $V_{reg}$, 1.5 volts.

In use, the control circuit 1 is connected as already described. The ground terminal 11 is connected to ground, the power supply terminal 12 is connected to the 12 volt PC voltage $V_{dd}$, the output terminal 15 is connected to the gate of the FET 2 which is already connected to the 3.3 volt voltage source $V_s$. The output 5 of the FET 2 is connected to the terminating resistors of the AGP bus on the PC motherboard. The feedback terminal 16 is connected to the output 5 from the FET 2. When the control terminal 3 is to be connected to the TYPEDET signal it is connected through the voltage divider circuit 8. The control terminal 3 is also connected to the switch 9, and a suitable control signal is applied to the gate 10 of the switch 9 for putting the control terminal 3 into the first state during power up by pulling the control terminal 3 to ground. As already described, the control terminal 3 may be left disconnected from the voltage divider circuit 8, in which case, the control terminal 3 would be in the fourth state and the control circuit 1 would control the FET 2 to output the regulated output voltage $V_{reg}$ of 1.5 volts. When the control terminal 3 is connected to the TYPEDET signal through the voltage divider circuit 8, depending on the TYPEDET signal, the control terminal 3 will be in one of the second and third states, and the control circuit 1 controls the FET 2 for outputting either the regulated output voltage $V_{reg}$ of 1.5 Volts or the output voltage $V_{out}$ of 3.3 volts.

It is envisaged that when the control circuit 1 is provided in the form of a chip, it may be provided as an eight pin chip, the additional three pins would be respectively configured to act as a control terminal for receiving a control signal, an output terminal for outputting a control signal to an electronic device, for example, a FET for controlling the output voltage of the FET, and the additional third terminal could be configured as a feedback terminal for feeding back the output voltage from the electronic device. A second amplifier or other suitable control circuitry would be provided on the chip for controlling the electronic device through the additional output terminal in response to the feedback on the additional feedback terminal and the state of the additional control terminal.

While the control circuit has been described for controlling a semi-conductor switch which is provided by a field effect transistor, the control circuit may be adapted for controlling any other semi-conductor switch, for example, any other type of transistor.

It will of course be appreciated that while specific voltages have been described, the control circuit would operate with any other suitable voltages.

What is claimed is:

1. A control circuit for controlling a semi-conductor switch in response to an input signal for selectively enabling and disabling the switch and for selectively operating the switch for outputting an output voltage at two respective selectable voltage levels from a single level voltage source when the switch is enabled, the control circuit comprising:

a control terminal operable in any one of at least three states in response to the input signal, an output terminal for applying a control signal to a gating input of the semi-conductor switch to enable the switch and to select the output voltage therefrom in response to the state of the control terminal, a ground terminal for connecting the circuit to ground, a power supply terminal at which the circuit is connectable to a power supply voltage, a feedback terminal at which feedback may be received from the output voltage from the semi-conductor switch, a decoder which determines the state of the control terminal, the decoder having an enable output and a select output, and being responsive to the state of the control terminal for outputting an enable signal and a voltage select signal, respectively, a regulating means for outputting the control signal to the output terminal, the regulating means being responsive to the enable signal from the decoding means for outputting the control signal for enabling the semi-conductor switch, and being responsive to the voltage select signal from the decoding means for setting the level of the control signal at one of two levels for selecting the voltage level from the semi-conductor switch in response to the state of the control terminal, and the regulating means being responsive to the feedback signal on the feed back terminal for regulating the control signal at one of the two levels for operating the semi-conductor switch to output a regulated voltage at the corresponding one of the two selectable voltage levels.

2. A control circuit as claimed in claim 1 in which the control circuit is for controlling a semi-conductor switch provided by a field effect transistor.

3. A control circuit as claimed in claim 1 in which the control circuit is for controlling a semi-conductor switch provided by a bi-polar junction transistor.

4. A control circuit as claimed in claim 1 in which the control circuit comprises the semi-conductor switch, and the voltage dividing means.

5. A control circuit as claimed in claim 1 in which the control circuit is for receiving an input signal provided by a TYPEDET signal from a sensor in a video card receiving slot, and for controlling the semi-conductor switch for selectively outputting the output voltage to terminating resistors of an AGP bus of a PC motherboard at a selected one of the two respective voltage levels in response to the state of the control terminal.

6. A control circuit as claimed in claim 1 in which the regulating means comprises an amplifier for outputting the control signal to the output terminal, the amplifier having a reference voltage input for receiving a reference voltage, and a feedback input for receiving the feedback voltage from the feedback terminal for comparison with the reference voltage, the level of the control signal outputted by the amplifier being responsive to the feedback voltage for regulating the voltage output of the semi-conductor switch at the regulated voltage level.

7. A control circuit as claimed in claim 6 in which the amplifier is powered by the power supply voltage, and the enable signal and the voltage select signal from the decoder are fed to control inputs of the amplifier.

8. A control circuit as claimed in claim 7 in which the control signal outputted by the amplifier at one of the levels is at a value approaching the supply voltage for forcing the semi-conductor switch to act as a low impedance switch for outputting the voltage at a level substantially similar to the source voltage to the semi-conductor switch.

9. A control circuit as claimed in claim 6 in which a reference voltage generating means is provided for applying the reference voltage to the reference voltage input of the amplifier.

10. A control circuit as claimed in claim 1 in which in a first of the at least three states of the control terminal, the control terminal is pulled to ground, and the regulating means is responsive to the control terminal being in the first state for outputting the control signal for disabling the semi-conductor switch.

11. A control circuit as claimed in claim 10 in which in second and third states of the at least three states of the control terminal, the control terminal is at respective different voltage levels, the different voltage levels being determined by the input signal being applied to the control terminal through a voltage divider connected to a secondary voltage supply, the voltage level on the control terminal in the second and third states being a function of the secondary voltage supply.

12. A control circuit as claimed in claim 11 in which the voltage divider is connected between the secondary voltage supply and an input terminal for receiving the input signal.

13. A control circuit as claimed in claim 12 in which the second state of the control terminal corresponds to the input signal being a voltage signal applied to the input terminal, and the secondary voltage lying between the power supply voltage and the voltage of the input signal, and the third state of the control terminal corresponds to the voltage on the input terminal floating.

14. A control circuit as claimed in claim 13 in which the control terminal is operable in a fourth state, namely, a floating state, the regulating means being responsive to the control terminal being in the fourth state for outputting the control signal at one of the two levels for operating the semi-conductor switch for outputting the output voltage at one of the two selectable levels.

15. A control circuit as claimed in claim 14 in which the control terminal is connected to the supply voltage through a high impedance for pulling the voltage on the control terminal to the supply voltage when the control terminal is in the fourth state.

16. A control circuit as claimed in claim 14 in which the regulating means is responsive to the control terminal being in the second and fourth states for outputting the control signal at the regulated level for selecting the semi-conductor switch to output the regulated voltage.

17. A control circuit as claimed in claim 14 in which the regulating means is responsive to the control terminal being in the third state for outputting the control signal at the level for selecting the semi-conductor switch to act as a low impedance switch for outputting a voltage substantially similar to the source voltage.

18. A control circuit as claimed in claim 14 in which the decoder has the enable and select outputs for outputting the enable and voltage select signals to the regulating means in response to the state of the control terminal, a first inverter and a second inverter connected between the control terminal and the decoder for determining the state of the control terminal, the inversion threshold voltage of the first and second inverters being less than the third state voltage of the control terminal, the inversion threshold voltage of the first inverter being less than the second state voltage of the control terminal, and the inversion threshold voltage of the second inverter being greater than the second state voltage of the control terminal.

19. A control circuit as claimed in claim 18 in which the decoder comprises a third inverter connected between the control terminal and the decoder for determining the state of the control terminal, the inversion threshold voltage of the third inverter being less than the fourth voltage state of the control terminal and greater than the third voltage state of the control terminal.

* * * * *